United States Patent [19]

Tanaka et al.

[11] Patent Number: 4,616,221

[45] Date of Patent: Oct. 7, 1986

[54] ELECTROMAGNETIC DISPLAY

[75] Inventors: Hidehiro Tanaka, Odawara; Takashi Ishii, Kawasaki, both of Japan

[73] Assignees: NEI Canada Limited, Toronto, Canada; MIWA Electric, Co. Ltd., Japan

[21] Appl. No.: 572,075

[22] Filed: Jan. 19, 1984

[51] Int. Cl.[4] ..... G09G 3/34

[52] U.S. Cl. ..... 340/783; 340/815.04; 340/815.26

[58] Field of Search ..... 340/815.05, 815.29, 340/783, 763, 815.04, 815.26

[56] References Cited

U.S. PATENT DOCUMENTS

| | | | |
|---|---|---|---|
| 3,469,258 | 9/1969 | Winrow | 340/783 |
| 3,916,403 | 10/1975 | Mandzsu et al. | 340/815.04 |
| 4,156,872 | 5/1979 | Helwig | 340/815.26 |
| 4,394,652 | 7/1983 | Nabette | 340/783 |
| 4,401,959 | 8/1983 | Enright et al. | 340/815.26 |
| 4,425,864 | 1/1984 | Skrobisch | 340/815.26 |
| 4,531,318 | 7/1985 | Chang et al. | 340/815.05 |

*Primary Examiner*—Gerald L. Brigance

*Attorney, Agent, or Firm*—Westell & Hanley

[57] ABSTRACT

An electromagnetic display or indicator element comprises a disc having a permanent magnet perpendicular to the disc's rotary axis. The disc is controlled by a single high remanence pole piece which has its forward end transversely (relative to the viewing direction) located relative to the disc to exert the main control on the magnet therein and its rearward end located rearwardly of the center of the disc.

4 Claims, 7 Drawing Figures

ELECTROMAGNETIC DISPLAY

BACKGROUND OF THE INVENTION

1. Field of the Invention

Figure 1:
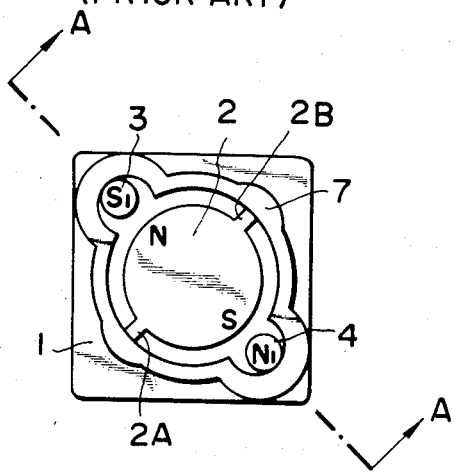
FIG. 1 (PRIOR ART)

This invention relates to an electromagnetic display or indicator element. The element uses a disc which is contrastingly colored on opposite sides and controlled to selectively display one or the other side in the viewing direction. Thus, the element may be used singly as an indicator or in an array to collectively form a display.

2. Description of the Prior Art

The element with which the invention is concerned is of the type where an disc is provided, rotatably mounted on a housing to rotate about an axis in the plane of the disc, and extending across approximately a central or diametrical line thereof. A permanent magnet is mounted on the disc to define a magnetic axis transverse to the rotary axis and preferably perpendicular thereto. The disc is contrastingly colored on opposite sides. The orientation of the disc, to display one or the other of the contrasting sides in a viewing direction is controlled by a pair of high remanence, magnetically permeable pole piece cores each having a forward end adjacent the locus of the disc permanent magnet. The forward ends of the pole pieces are located so that, when oppositely magnetized they control the disc through the permanent magnet to display one of its sides in the viewing direction. Where the polarity of both oppositely magnetized pole piece cores is reversed, the result is to reverse the orientation of the disc to display its other face in the viewing direction. Control of the magnetization of the pole piece cores is customarily provided by having a yoke joining them rearwardly of the disc with an energizing winding surrounding the yoke to be energized to magnetize the pole piece cores in one or in the other polarity.

One disadvantage of the conventional arrangement is that the collective shape of the cores and yoke makes the provision of an energizing winding on the yoke awkward, difficult and expensive. A further disadvantage is that the high remanence magnetically permeable material of the cores (typically a ferrous alloy) is expensive and the design requires two such cores. A further disadvantage is that, since the yoke runs transverse to the viewing direction, an increase in the winding thickness to provide more turns results in a corresponding increase in the depth of the unit i.e. the dimension measured in the viewing direction. Increase in such dimension creates design and housing problems which are difficult and expensive to solve.

SUMMARY OF THE INVENTION

It is an object of this invention to provide an electromagnetic display or indicator element wherein a disc having a permanent magnet perpendicular to the disc's rotary axis is controlled by a single high remanence pole piece which has its forward end transversely (relative to the viewing direction) located relative to the disc to exert the main control on the magnet therein and its rearward end located rearwardly of the centre of the disc.

"Forward" and "rearward" herein refer to the directions from the element toward and away respectively from the intended viewer's position.

The 'viewing axis' is the line, parallel to the viewing direction which passes through the centre of the disc.

It follows from the description of the device in the previous paragraph that the rearward extent of the high remanence pole piece core located approximately upon the viewing axis rearward of the disc. It will be obvious that it is far cheaper and more convenient to provide the energizing winding for the pole piece on such rearward extent than on the yoke of the prior art device. Secondly, it will be noted that the device as provided by this invention requires only one pole piece core in comparison to the two required by the prior art. Thus, a material saving in the cost of the relatively expensive pole piece core material is achieved. Thirdly, it will be noted that the axis of the pole piece rearward extent and hence of its winding extends in the viewing direction. Thus, an increase in the thickness of the winding, to obtain more turns does not increase the depth of the device, a very important feature. A further advantage has been observed which is that the inventive device has a low susceptibility to hang-ups even though no extra magnetic biassing means are provided.

A preferred embodiment is provided wherein a molded plastic housing supports the pole piece and the disc and rearwardly of the disc locus is molded to provide a bobbin or winding location rearwardly of the disc or which the winding may conveniently be placed.

Figure 2:
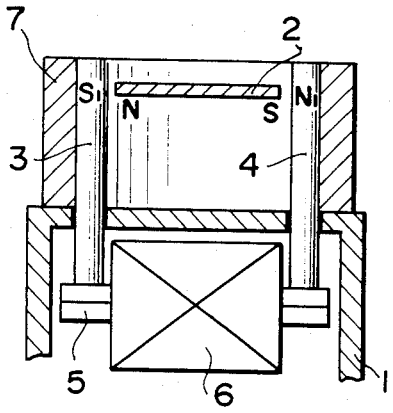
FIG. 2 (PRIOR ART)
Figure 3:
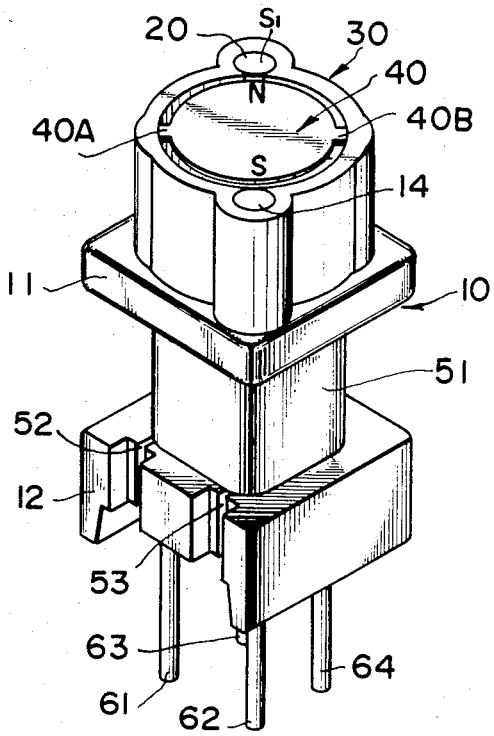
Figure 4:
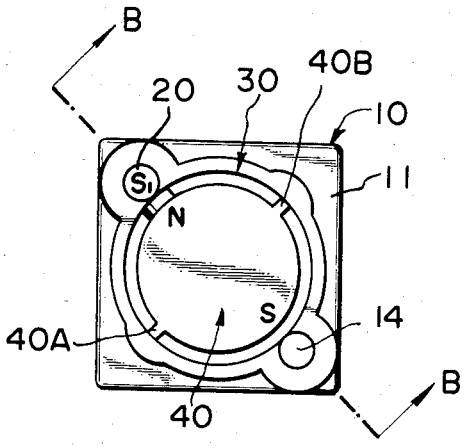
Figure 5:
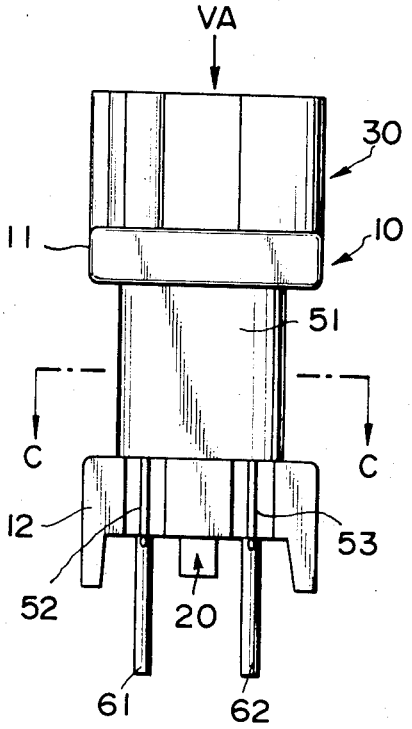
Figure 6:
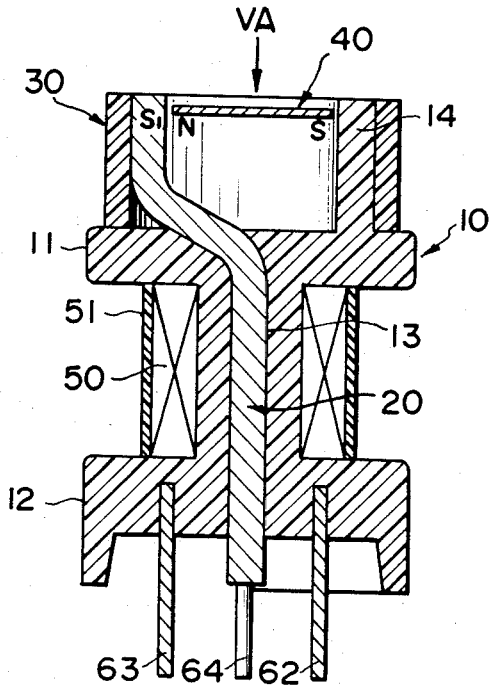
Figure 7:
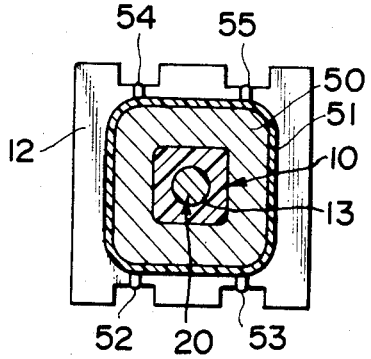

In drawings which illustrate a preferred embodiment of the invention:

FIG. 1 is a top plan view showing a conventional prior art display or indicating element, FIG. 2 is a cross section of the device in FIG. 1 taken along the line A—A of FIG. 1, FIG. 3 is a perspective view of a display or indicating element in accord with the invention, FIG. 4 is a top plan view of the element of FIG. 3, FIG. 5 is a side view of the display element of FIG. 3, FIG. 6 is a cross section taken along the line B—B of FIG. 4, and FIG. 7 is a cross section taken along the lines C—C of FIG. 5.

FIGS. 1 and 2 show a conventional prior art reversible display or indicating element. This conventional element has a display disc, contrastingly coloured on opposite sides, as the reversible display member, rotatably supported on the upper portion of the housing, on axes 2A, 2B. This display disc 2 is magnetized, or has a permanent magnet to provide a north pole N and a south pole S each approximately located in the plane of the disc and located to define a magnetic axis perpendicular to the rotation axis. Moreover the poles N and S are approximately symmetrically located relative to the rotation axis.

The disk is driven by exterior magnetic field forming means comprising energizing coil 6 on magnetically permeable yoke 5. High remanence magnetically permeable pole piece cores are connected in the same magnetic circuit as the yoke and at both ends thereof. Frame 7 is designed to rotatably mount disc 2 and to be mounted on housing 1 on the forwardly extending portions of pole pieces 3 and 4 which are in turn mounted on housing 1. In this conventional prior art element, when an energizing pulse is applied in one direction through coil 6 the forward ends of pole pieces 3 and 4 are oppositely magnetized in one sense to provide the magnetic poles $N_1$, $S_1$, shown in FIG. 2. The display member is moved to and held in the position shown in FIG. 2 by the effect of the poles $N_1$, $S_1$, on the magnet of the disc. When current is applied to the winding 6 in the opposite sense the polarities of the forward ends of cores 3 and 4 are reversed from those shown in FIGS. 1 and 2 causing disc 2 to rotate about its axes defined by 2A and 2B to display the opposite face in the viewing direction.

This conventional display or indicating element requires the winding of coil 6 or yoke 5 which already has cores 3 and projecting transversely therefrom. Such winding is troublesome, awkward and expensive. The cost of the two cores, 3 and 4 (usually a high remanence ferrous alloy) is high which is reflected in a high cost for the unit. Further, when the number of turns is increased it will be obvious that the depth of the device must be increased in the viewing direction, increasing the problems of housing and mounting the device.

The inventive device, shown in FIGS. 3–7 overcomes the disadvantages of the conventional arrangement.

The device of FIGS. 3–7 comprises a housing 10 with a display disc 40 rotatably mounted therein on an axis in the media plane of the display disc and located to divide the display disc approximately symmetrically. The permanent N and S poles of the display disc or of a permanent magnet mounted thereon are located approximately in the median plane of the disc and approximately symmetrically on opposite sides of the rotary axis and define a magnetic polar axis approximately perpendicular to the rotary axis. A high remanence magnetically permeable core member 20 in the form of a bar of preferably ferrous alloy provides forward and rearward parallel extents joined by an intermediate curved extent to transversely displace the forward extent from the rearward. The core member is herein discussed as having a straight rearward extent and a forward extent including the curved and forward straight portion. The member 20 is shaped and located so that the rearward extent is located on the viewing axis of the element, i.e. the line VA (FIGS. 5 and 6) parallel to the intended viewing direction through the central portion of the disc. The curved extent avoids the locus of the rotatable disc and the forward straight extent is located to magnetically influence the nearer permanent magnet pole of the disc, most strongly, when the latter is oriented transverse to the viewing direction. An energizing winding 50 is wound about the rearward extent of member 20 to control its polarity. A detailed description of this invention follows.

The novel display element is provided with a housing 10 formed in the shape of a winding bobbin with a forward flange 11, an rearward flange 12, and an forwardly-rearwardly extending axial aperture 13. The aperture 13 is shaped to frictionally and slidably receive and retain the rearward straight extent of the permeable core member 20. The permeable member 20 thus extends forwardly from its rearward end along the viewing axis to a location rearward of the disc locus and is then bent to clear the disc and again bent to extend forwardly approximately parallel to the viewing direction. The forward end of the member 20 is located clear of the disc locus but in a position to influence the permanent magnet of the disc, and to tend to orient the disc transverse to the viewing direction. The housing 10 is preferably made of molded plastic. The housing 10 is moulded to integrally provide a forwardly projecting support post 14 which is non magnetic but is physically of the same shape and extent as the forward extent of member 20 and symmetrically disposed across the rotary axis therefrom. Such post 14 and the forward end of member 20 are received in corresponding bores in disc support frame 30 and support the latter on the housing. The support frame 30 has a large central aperture to allow the rotation of the disc 40 therein and frame 30 is designed to rotatably mount disc 40 on pins 40A, 40B in any manner well known to those skilled in the art. An energizing winding 50 for the core 20 is wound on housing extent between forward and rearward flanges 11 and 12 which are provided to form a winding bobbin for that purpose. The exterior surface of winding 50 is preferably provided with protective insulating tape 51. At the lower flange 10 of the housing 10 are fitted connection terminals 61, 62, 63 and 64. Coil 50 is preferably bifilar. Lead Wires 52 and 53 for energizing one filament of the driving coil 50 in one sense are connected to the connection terminals 61 and 62 by soldering. Lead wires 54 and 55 for the other filament of driving coil 50 are connected to the connection terminals 63 and 64 by soldering.

It will be noted that in each polarity of the forward end of core 20 the disc 40 will display one of its faces in the viewing direction which is approximated perpendicular to the median plane of the disc in either of its stable orientations. The viewing axis VA is parallel to the viewing direction and runs through the centre of the disc and substantially intersects the rotation axis. It will be noted that the core rearwardly of the flange 11 is substantially coaxial with the viewing axis. It will also be noted that the core 20 is chosen of material (usually a ferrous alloy) to have sufficiently high remanence to retain its magnetic polarization between those current pulses in winding 50 which switch its polarity, when the disc is retained in position by the polarity determined by the last pulse without sustaining current in winding 50. Moreover the coercivity of core 20 is chosen so that its polarity as determined by the last pulse is not altered by the nearer permanent magnet pole on the disc.

In the operation of the inventive device, when current in one sense is applied to the driving coil through the connection terminals 61 and 62, the forward end of core 20 is magnetized to be the pole $S_1$ (FIG. 6). Thus, the display disc 40 having its permanent magnet poles N and S located symmetrically across the rotation axis and perpendicularly disposed with respect thereto, is oriented so that its pole N is attracted to the pole $S_1$. The orientation of the disc is maintained after the current has ceased. When a current in the opposite sense is applied to the driving coil 50 through the connection terminals 63 and 64, the polarity of the forward end of core 50 is reversed to become $N_1$ causing the disc 40 to be rotated about its axis 40A–40B by the core 20 forces to display the opposite dide of disc 40 in the viewing direction. This disc orientation is retained after the cessation of the energizing current until the disc is again reversed due to the switching of core 20 to produce polarity $S_1$ at its forward end through current through terminals 61 and 62.

The display or indicating unit of this invention requires only a single core member of the high remanence ferrous alloy material which material is expensive. Thus the cost of the device can be reduced substantially resulting in a substantial reduction in the overall price of the element. Further the structure of the element, in its preferred embodiment, is such that the energizing coil may be wound about the straight rearward extent of the core greatly simplifying the troublesome winding procedure inherent in the prior art arrangement. In the preferred embodiment, further, the rearward portion of the housing is formed in a winding bobbin shape then the core 20 may have its rearward straight extent inserted rearwardly to the bore and the energizing winding wound thereabout. Thus the assembly and winding operation is simpler and easier. Since the axis of the winding is in the viewing direction and space is provided on the bobbin, a fair volume of winding may be provided and an increase in the turns of the winding does not result in a increase of the dimensions of the element. Thus, the dimensions of the display disc can be large relative to the corresponding area of the element as seen in the viewing direction, leading to a large dimensional factor or display efficiency. Also, and thus is related to the efficiency of the magnetic drive arrangement less "hang-ups" are encountered in rotating the disc of the new development relative to the prior art arrangement shown.

We claim:

1. Electromagnetic display or indicator element for viewing in a viewing direction, comprising:

a display disc, contrastingly colored on opposite sides, pivotally mounted on said housing, with the pivotal axis located approximately midway across said disc, said pivotal axis being approximately perpendicular to said viewing direction, a permanent magnet located on said disc to define north and south poles on said disc on opposite sides of said pivotal axis, a viewing axis being a line parallel to the viewing direction, passing through said pivotal axis and approximately midway between the edges of the disc, a high remanence magnetically permeable core including:

a rearward extent extending approximately along the viewing axis and located rearward of the locus of said disc; and a forward extent extending from said rearward extent, outside the locus of said disc to a forward end located transversely from the centre of said disc relative to the viewing direction, and relative to the viewing axis, whereby for one and the opposite polarity of said forward end, said forward end will, through said permanent magnet, control said disc to display one and the other side, respectively, in the viewing direction.

2. Element as claimed in claim 1 wherein said rearward extent is straight and substantially coincident with said viewing axis.

3. Element as claimed in claim 1 wherein said housing includes a winding bobbin formed about said rearward extent.

4. Element as claimed in claim 2, wherein said housing includes a winding bobbin formed about said rearward extent.

* * * * *